United States Patent [19]

Aihara et al.

[11] Patent Number: 4,682,914

[45] Date of Patent: Jul. 28, 1987

[54] HYDRAULIC TRENCH SUPPORT

[76] Inventors: Isamu Aihara, 3-5, 3-chome, Nagaremachi, Hirano-ku, Osaka; Tsuneo Yoshimura, 13-10, Nihombashi-Odemmacho, Chuo-ku, Tokyo, both of Japan

[21] Appl. No.: 811,998

[22] Filed: Dec. 23, 1985

[51] Int. Cl.[4] ..... E02D 17/08

[52] U.S. Cl. ..... 405/283; 405/142

[58] Field of Search ..... 405/282, 283, 272, 290, 405/142

[56] References Cited

U.S. PATENT DOCUMENTS

| | | | |
|---|---|---|---|
| 3,230,720 | 1/1966 | Bennett | 405/282 |
| 3,347,049 | 10/1967 | Faltersack et al. | 405/282 |
| 3,851,856 | 12/1974 | Berg | 405/282 |
| 3,995,565 | 12/1976 | Kersey | 405/282 |
| 4,252,476 | 2/1981 | Koppers et al. | 405/290 |
| 4,453,863 | 6/1984 | Sutton et al. | 405/282 |

FOREIGN PATENT DOCUMENTS

| | | | |
|---|---|---|---|
| 3024143 | 1/1982 | Fed. Rep. of Germany | 405/283 |

*Primary Examiner*—Cornelius J. Husar
*Assistant Examiner*—Peter M. Cuomo
*Attorney, Agent, or Firm*—Erik M. Arnhem

[57] ABSTRACT

A hydraulic trench support includes a piston and cylinder head supported within a cylinder such that the cylinder head is fixed at one end of the cylinder and the piston is moveable within the cylinder. A piston rod is coupled to the hydraulic piston at one end and extends outside the cylinder and beyond at the other end. A pair of load bearing bases having generally planar construction are attached to the piston rod portion extending beyond the cylinder and to the cylinder head. Means are provided for introducing a fluid under pressure into the cylinder between the inwardly facing surfaces of the cylinder head and piston to provide an outwardly expanding force there between which is coupled to the base members to provide a sidewall retaining force. In one embodiment, spring means are provided which bias the hydraulic trench support toward a contracted position in the absence of fluid pressure.

5 Claims, 5 Drawing Figures

HYDRAULIC TRENCH SUPPORT

BACKGROUND OF THE INVENTION

This invention relates generally to shoring devices used to support the sidewalls of deep narrow excavations and particularly to those utilizing a hydraulically operable expansion device to exert a retaining force against the sidewalls of the excavation.

In the situations in which a deep, relatively narrow excavation or trench is dug for purposes such as routing of sewers, pipes, gas systems or underground cables, a problem arises in that the material forming the soils through which the excavations are undertaken, frequently is subject to the likelihood of being displaced from the sharp vertical walls of the trench. This problem is particularly critical in operations which require that labourers or craftsmen must operate within the trench to carry out necessary activities. In such circumstance, the potential for cave in or fill in of the trench sidewalls may place the lives of the workers within the trench in jeopardy.

These and other problems in the operations of such trench excavations have caused practitioners in the art of constructing shoring devices to improve the traditional timber fabrication shoring devices by using the more modern metal sidewall constructions which vary greatly in construction detail, but generally comprise substantially vertical reinforcement members placed along the trench sidewalls, generally in a top to bottom orientation which are used in combination with and connected to interspaced expandable members. The latter which are operative to exert an outward force against the shoring devices and the trench sidewalls in order to retain the soil and prevent cave in of the sidewalls.

The expandable reinforcing member used in such shoring devices has in the past been fabricated using either of two popular techniques. The first, an example of which is set forth in U.S. Pat. No. 3,393,521 sets forth an expandable member in which a screw type expander mechanism is utilized. In the system shown, an externally threaded shaft is terminated at one end in a load bearing surface. In operation, expansion of the shoring member takes place by rotating the threaded collar with respect to the threaded shaft, causing the threaded shaft to be forced out of the collar.

To meet this problem, practitioners in the art have devised a second expandable member technology in which an expandable hydraulic cylinder coupled to a source of hydraulic fluid under pressure is operative to hydraulically force to load bearing ends of the cylinder member in opposite directions, and exert the appropriate retaining forece against the shoring structure. While a number of such devices have been constructed in the art and their constructions differ in some subtleties, all generally comprise a hydraulic cylinder having a piston within a cylinder and a pair of load bearing surfaces attached one to the cylinder and the other to the piston. A port introduces hydraulic fluid under pressure to the cylinder interior and the pressure of the hydraulic fluid is exerted against the piston driving the piston within the cylinder, thereby creating an expansion under force. U.S. Pat. No. 3,404,533 sets forth such a hydraulic device in which a linkage arrangement couples the hydraulic devices to a pair of vertical shoring members in a pivotal manner and in which means are provided to lock the shoring rails and expandable members in place once installed. Similarly, U.S. Pat. No. 3,347,049 sets forth a hydraulically operable shoring device in which a similar structure to the 533 patent is shown with the advantage that a releaseable coupling is used in connecting the expandable cylinders to the shoring rails. By way of further refinement, U.S. Pat. No. 3,362,167 sets forth a hydraulically operated shoring device in which an oversleeve surrounds the hydraulic cylinder and piston arrangment and acts as a protective device while adding further strength to the hydraulic cylinder for side loading and impacts. Finally, U.S. Pat. No. 3,230,720 sets forth a hydraulically operable shoring device in which a pair of shoring rails are pivotably coupled to expandable hydraulic cylinders in a similar manner to the devices set forth above with the further refinement that means are provided for limiting the angle between the expandable cylinders and the shoring rails to the right angles.

While such combination expandable cylinders and shoring rail devices, as shown in the above referenced prior art, work satisfactorily in the majority of applications, there exists a need in the art for a more lightweight, easily assembled hydraulic expansion cylinder having increased ease of installation and withdrawal.

SUMMARY OF THE INVENTION

Accordingly, it is a general objective of the present invention to provide an improved hydraulically expandable cylinder trench shoring device. It is a more particular object of the present invention to provide an improved hydraulic trench shoring device having increased ease of installation and removal.

Accordingly, there is provided in accordance with the present invention, a fluid pressure type shoring device having a hollow piston rod bearing a piston at one end moveably fitted within a cylinder. A pair of load bearing bases are configured to have a substantially planar load bearing surface and an inwardly extending boss. The inwardly extending bossess cooperate with means on the hollow piston rod and the piston cylinder to permit removeable attachment thereto by a vertically displaced pin member. The bases each support and outwardly facing bracket member suitable for resting upon and engaging the vertical portion of the shoring devices and a vertically oriented hanger suitable for engaging a lifting hook or line used to lower the trench shoring support into position from above the trench. A connecting port is coupled to the cylinder portion between the piston head and the piston and provides access to a source of pressurized fluid. Also provided are spring means which bias the support toward a contracted position in the absence of fluid pressure.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings in the several figures of which like reference numerals identify like elements and in which:

DESCRIPTION OF THE PREFERRED EMBODIMENT

Figures 1, 2, 3:
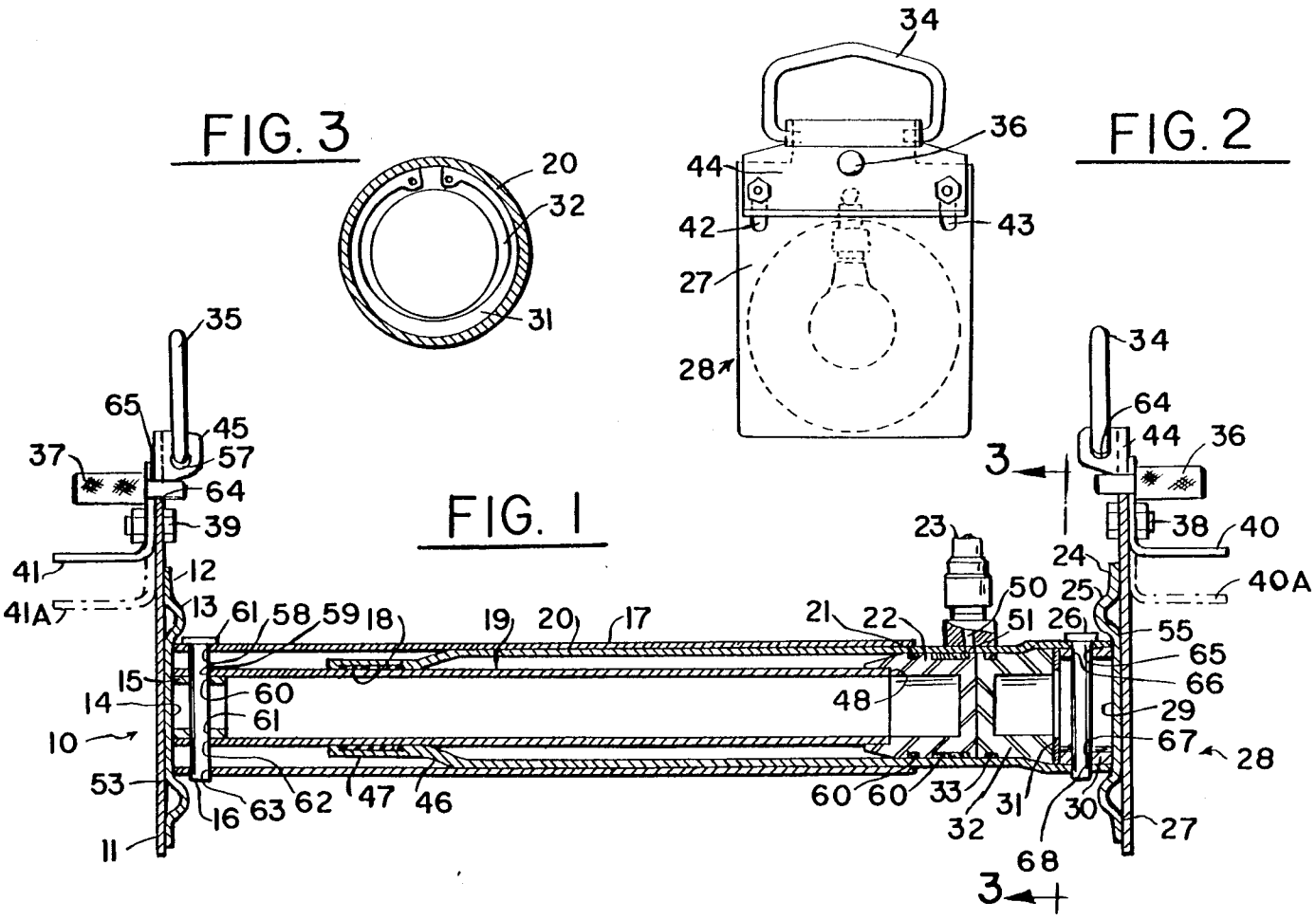
FIG. 1 is a sectioned elevation view of a hydraulic trench support constructed in accordance with the present invention.
FIG. 2 is a side view of a hydraulic trench support constructed in accordance with the present invention.
FIG. 3 is a section view of a portion of the present invention, hydraulic trench support taken along section lines 3—3 in FIG. 1.

FIG. 1 sets forth a hydraulic trench support constructed in accordance with the present invention. The hydraulic trench support includes a cylindrical piston rod 19, which defines a pair of apertures 60 and 61, near one end. A generally, cylindrical hollow cylinder 20, defines a pair of apertures 65 and 68, and a snap ring groove, at one end and a reduced section neck 46, and collar portion 47, at the other end.

Collar 47 supports cylindrical bearing seal 18. A cylinder head 32, configured to nest within cylinder 20 is maintained at the end of cylinder 20 proximate ring groove 56 by a snap ring 31. Cylinder head 32 further defines an annular seal 33 interposed between the outer surface of cylinder head 32 and the inner surface of cylinder 20. The resulting structure provides a fluid tight seal at the cylinder head end of cylinder 20 in combination with cylinder head 32 and seal 33. In accordance with an important aspect of the present invention, snap ring groove and snap ring 31 cooperate to secure cylinder head 32 without the added weight and expense of the piror, are threaded fabrications. A piston 22 has a generally cylindrical shape and defines a plurarlity of seal grooves 60. A plurality of annular seals 21 are fitted within seal grooves 60 and are captivated between the outer surface of piston 22 and the inner surface of cylinder 20. Piston 22 further defines a recess 48 which receives one end of piston rod 19 in a secure fit whereby piston 22 is connected to and born by piston rod 19. The cooperation of seals 21 with the inner surface of cylinder 20, provides a fluid between the outer surface of piston 22 and the inner surface of cylinder 20. Piston 22 is moveable axially within cylinder 20 to vary the distance between piston 22 and cylinder head 32. A protective barrel 17 having a general cylindrical structure encloses cylinder 20 for a substantial portion of its length and defines a pair of apertures 58 and 63 at the end most remote from piston 22.

A base generally indicated by the reference numeral 10, defines a substantially planar base plate 11 and a circular disc plate 12. Disc plate 12 further defines an annular raised ridge 13 which surrounds a surface 14 on disc plate 12. Disc plate 12 is welded to base plate 11 to form a rigid load bearing unit. Base plate 11 further defines a raised cylindrical boss 15 which extends through disc plate 12 and defines a pair of apertures 60 and 61. Boss 15 is sized to fit within the interior of piston rod 19 in a close tolerance fit. With base 10 assembled to piston rod 19 barrel 17 as shown in FIG. 1, apertures 58, 59, 60,61, 62 and 63 are in substantial alignment permitting a pin 16 having a generally elongated structure and defining a head 61 to be inserted in apertures 58 through 63 to secure barrel 17 piston rod 19 and boss 15 together in a mechanical coupling. A flange 41 is moveably attached to base plate 11 by a fastener 39. Flange 41 further defines an aperture 65. Base plate 11 further defines an aperture 64. A pin 37 is inserted into apertures 64 and 65 to maintain the relative position of flange 41 and base plate 11. Base plate 11 further defines a bracket 45 which in turn defines an aperture 57 and an aperture 66 (not shown). A extruded generally U-shaped wire hanger 35 inwardly extending has end portions passing through apertures 57 and 67.

A second base 28 includes a structure substantially similar to base 10 in which a planar base plate 27 and a disc plate 24 having a structure identical to base plate 11 and disc plate 12 are welded together such that ridge 25 encircles a raised boss. Boss 30 defines a pair of apertures, 66 and 67, and is welded to base plate 27. In similar manner to the attachment set forth above of base 10 to piston rod 19 and barrel 17, base 28 is attached to the end of cylinder 20 by the insertion of a pin 26, through apertures 65, 66, 67 and 68. The resulting structure provides a load bearing surface on one end of cylinder 20. In further similarity to the structure of base 10, base 28 defines a pair of slots, 42 and 43 (shown more clearly in FIG. 2). A flange, 40, is secured to base plate 27 by a pair of fasteners, 38. In similarity to the structure of flange 41 and base plate 11, a pin 36 is inserted into a selected one of apertures 44 to align flange 40 with respect to base plate 27. A bracket 44 formed at one end of base plate 27, receives a hanger 34 similar in structure to hanger 35 of base 10.

A fluid connecting port 23 includes a fluid passage 50 attached to the outer surface of cylinder 20 overlying an aperture 51 in the wall of cylinder 20. In accordance with well known hydraulic cylinder fabrication techniques, connecting port 23 provides a means of introducing or withhdrawing a fluid under pressure into the space between piston 22 and cylinder head 32.

FIG. 2 shows an end view of the hydraulic trench support of FIG. 1, showing the planar construction of base 28 and the relative positions of flange 40 and hanger 34.

FIG. 3 shows a section view of the combination of snap ring 31, cylinder 20 and cylinder head 32. As can be seen, the cooperation of snap ring 31 and cylinder 20 provides a mechanism for retaining cylinder head 32 within cylinder 20 without a threaded fastening. Snap ring 31 is maintained within cylinder 20 by its spring like character in accordance with which it tends to expand outwardly against cylinder 20. As is shown in FIG. 1, the position of snap ring 31 along cylinder 20 is maintained by the fit of snap ring 31 within ring groove 56 which in turn secures the position of cylinder head 32 against fluid pressure.

In operation, pressurized fluid under pressure introduced through connecting port 23 travels through fluid passage 50 and aperture 51 to the interior of cylinder 20 in the region between the inwardly facing surfaces of piston 22 and cylinder head 32. Due to the pressure of the hydraulic fluid thus coupled, a force is exerted against piston 22 and cylinder head 32, causing piston 22 to be driven axially within cylinder 20 away from cylinder head 32. This outward or expanding force exerted against piston 22 is coupled by piston rod 19 to base 10 while the corresponding outward force exerted upon cylinder head 32 is coupled by snap ring 31, snap ring groove 56, and boss 30 to base 28. As a result, an expansion force is created which drives base 10 and base 28 apart. In normal application of a trench support system, the present invention, hydraulic trench support, is positioned within the trench support system on opposite sides of the trench. Whereupon the application of the above described expanding force causes bases 10 and 28 to exert a force against the shoring member of the trench thereby retaining the sidewall integrity. Flanges 40 and 41 serve as vertical support members whereby the initial position of the trench support may be rested upon the trench shoring members when the hydraulic trench support is lowered into position as described below.

The hydraulic trench support of the present invention is removed from its expanded position by releasing the pressure of the fluid coupled through connecting port 23 whereby the resisting force of the shoring system drives bases 10 and 28 toward each other causing piston 22 and cylinder head 32 to be driven toward each other by corresponding distance. In the absence of fluid pressure, this motion of piston 22 and cylinder head 32 causes fluid to be transferred out of the interior of cylinder 20 through aperture 51 and fluid passage 50 through connecting port 23. With the release of hydraulic pressure, the hydraulic trench support may be compacted and removed from the shoring assembly.

In accordance with an important aspect of the present invention, pin 16 provides the sole retaining mechanism between piston rod 19 and barrel 17 to base 10. Similarly, pin 26 provides the sole retaining mechanism between cylinder 20 and base 28. Accordingly, bases 10 and 28 may be removed from the hydraulic cylinder portion of the present invention, hydraulic trench support, by removal of pins 16 and 26. This provides considerable advantage in using the hydraulic cylinder portion of the present invention hydraulic trench support in combination with other base structures and facilitates easy servicing and repair of the assembly.

Figure 4A:
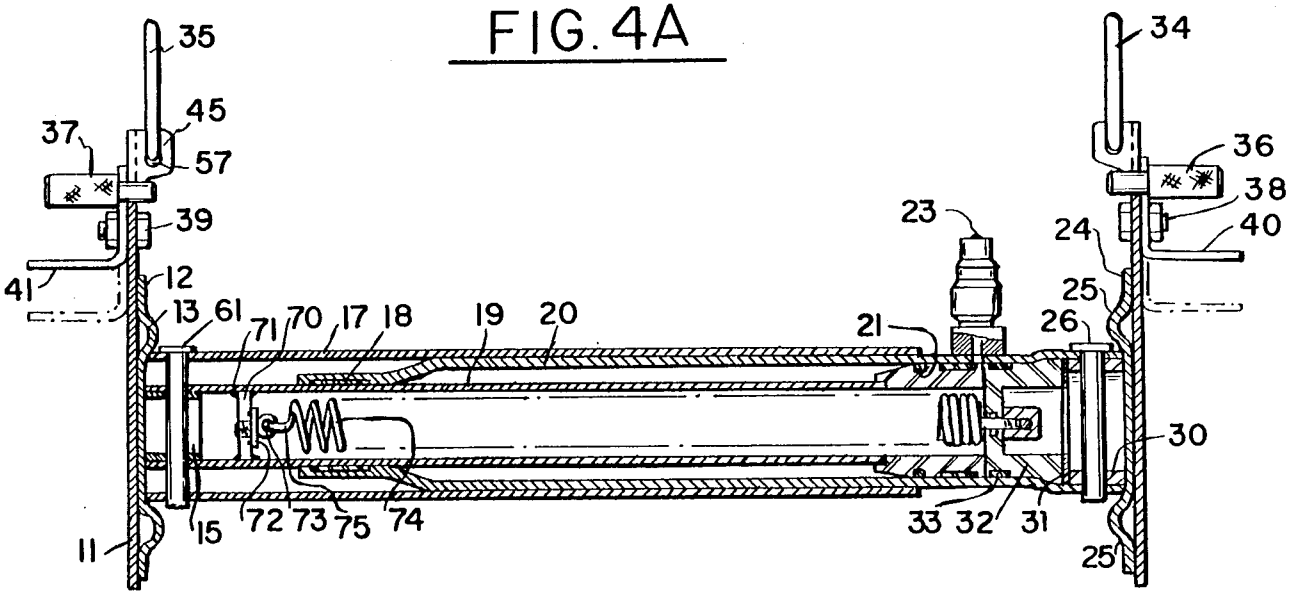
FIGS. 4A and 4B are section views of the present invention hydraulic trench support including contracting spring bias means.
Figure 4B:
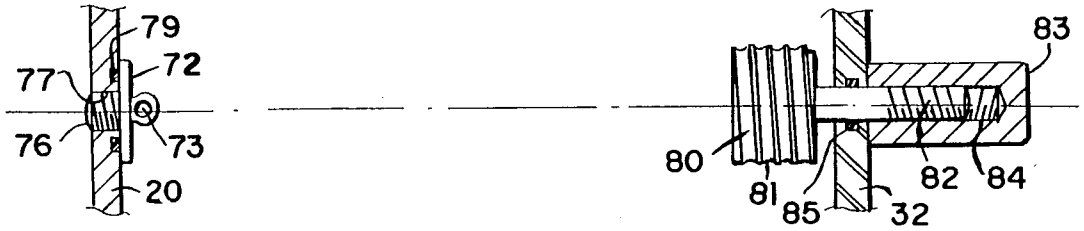

FIGS. 4A and 4B show an alternate embodiment of the present invention hydraulic trench support which utilizes essentially all of the components of the embodiments of FIG. 1 with additional components which provide a spring bias tending to contract the hydraulic support in the absence of fluid pressure.

FIG. 4A shows a plate 70 having a center threaded aperture 77 and a seal 79. Plate 70 is attached to the interior of piston rod 19 by welds 71. A flange 72 defines a fastener 76, which cooperates with aperture 77 to secure flange 72 to plate 70, and an eyelet 73. A spring holder 80 defines a set of helix grooves 81 and a threaded shaft 82. Cylinder head 32 defines an aperture 86 and an annular seal 85. Aperture 86 receives threaded shaft 82 and seal 85 forms a fluid tight seal therebetween. A cap 83 defines a threaded aperture 84 which receives threaded shaft 82 and secures springholder 80 to cylinder head 32. As spring 74 defines a hook 75 which cooperates with eyelet 73 to attach one end of spring 74 to flange 72. The other end of spring 74 is received by grooves 81 in a thread-like engagement to secure spring 74 to cylinder head 32.

In operation, the tension of spring 74 urges piston rod 19 toward cylinder head 32 to contract the support. When fluid is introduced the force of spring 74 is overcome and the support expands in accordance with the above described operation. Upon release of pressure spring 74 contracts moving piston rod 19 inward to contract the support and facilitate removal or relocation.

In this manner the present invention support moves to a contracted position when not under pressure making it easy to remove or reposition.

In its normally intended use, the present invention hydraulic trench support is lowered into the trench shoring structure in a contracted position and suspended by hangers 34 and 35 until flanges 40 and 41 rest upon the portions of the trench shoring structure which are desired to be supported. With the hydraulic trench support thus positioned, the operator then applies the appropriate fluid pressure through connecting port 23 from an above ground source of hydraulic fluid under pressure causing bases 10 and 28 to be forced against the shoring members. In this manner and in accordance with an important aspect of the present invention, the operator need not enter the trench to install the hydraulic trench support. Accordingly, the safety of operating personnel is maximized by complete installation from above ground.

What has been shown is a lightweight, easy to assembly and easy to use hydraulic trench support which is completely operable and installable from outside and above the trench.

While the foregoing has illustrated and described what is now contemplated to be the best mode of carrying out the invention, the description is of course subject to modifications without departing from the spirit and scope of the invention. Therefore, it is not desired to restrict the invention to the particular constructions illustrated and described, but to cover all modifications that may fall within the scope of the appended claims.

What is claimed is:

1. A hydraulic trench support comprising:

an expandable hydraulic assembly having a cylinder having an interior passage terminating in first and second open ends and defining an annular snap ring groove near said first end of said cylinder and a taper spaced from and extending inwardly from said snap ring groove, a snap ring expandably fitted within said snap ring groove, a cylinder head defining a tapered portion fitted within said first end of said cylinder and maintained in a fixed position within said interior passage by the cooperation of said tapers in one direction and by said snap ring in the other direction, a hollow piston rod within said cylinder interior passage having first and second ends, a piston attached to said first end of said piston rod, and means for transferring a fluid under pressure into or out of said interior passage between said piston and said cylinder head;

a first base having a first substantially planar load bearing surface and a first cylindrical cross-sectioned boss removably coupled to said second end of said piston rod, a first flange coupled to said first load bearing surface and extending in the opposite direction of said first boss, and first hanger means for attaching a supporting line to exert a lifting force upon said first base;

a second base having second substantially planar load bearing surface and a second cylindrical cross-sectioned boss removably coupled to said first end of said cylinder, a second flange coupled to said second load bearing surface and extending in the opposite direction or said second boss and second hanger means for attaching a supporting line to exert a lifting force upon said second base.

2. A hydraulic trench support as set forth in claim 1 wherein said first cylindrical cross sectioned boss and said second end of said piston rod each define a pair of commonly aligned apertures and wherein said hydraulic trench support further includes a first removeable pin insertable into said pairs of apertures in said first cylindrical cross sectioned boss and said second end of said piston rod.

3. A hydraulic trench support as set forth in claim 2 wherein said second cylindrical cross sectioned boss and said second end of said cylinder each define a pair of commonly aligned apertures and wherein said hydraulic trench support further includes a second removeable pin insertable into said pairs of apertures in said second cylindrical cross sectioned boss and said second end of said cylinder.

4. A hydraulic trench support as set forth in claim 3 further including a hollow cylindrical barrel having a first end attached to said first base and surrounding a portion of said cylinder.

5. A hydraulic trench support as set forth in claim 2 further including an internal spring having first and second ends and means attaching said first end of said spring to said piston rod and means attaching said second end of said springs to said cylinder head such that said spring extends between said cylinder head and said piston rod within said hollow piston rod exerts a contracting force between said cylinder head and said piston rod.

* * * * *